US006935843B2

(12) United States Patent
Wang

(10) Patent No.: US 6,935,843 B2
(45) Date of Patent: Aug. 30, 2005

(54) FAN BLADE WITH IMPROVED MIX FLOW FAN

(75) Inventor: Fu-Yin Wang, Taipei (TW)

(73) Assignee: Datech Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 10/731,507

(22) Filed: Dec. 10, 2003

(65) Prior Publication Data

US 2004/0126233 A1 Jul. 1, 2004

(30) Foreign Application Priority Data

Dec. 27, 2002 (TW) ..... 91221265 U

(51) Int. Cl.[7] ..... F04D 29/28

(52) U.S. Cl. ..... 416/243; 415/218.1

(58) Field of Search ..... 416/234, 243; 415/218.1, 219.1

(56) References Cited

U.S. PATENT DOCUMENTS 4,618,315 A * 10/1986 Papst et al. ..... 417/354
6,082,969 A * 7/2000 Carroll et al. ..... 416/192

* cited by examiner

*Primary Examiner*—Ninh H. Nguyen
(74) *Attorney, Agent, or Firm*—Troxell Law Office, PLLC

(57) ABSTRACT

The present invention relates to a structural reinforcement of the fan wheel of a mixed flow fan. The structure of the fan wheel comprises a hub and several blades attached to the outer rim of this hub. One side of the hub consists of a hollow space, the other side consists of a flat surface. The blades are attached to the outer rim of the hub in equal distances. The outer rim of the hub is beveled. The flat surface acts as the air inlet side, the hollow side acts as the air outlet side. The surfaces of the blades are to bend. The part connecting the blades to the hub is also to bend. Therefore cambered channels form in the gaps between the blades, which are arranged in equal distances. Through use of this structure the operational area for the characteristic curve of the mixed flow fan is increased and the possibility of a loss of speed is reduced. Thus the overall performance of the fan is improved.

1 Claim, 6 Drawing Sheets

FAN BLADE WITH IMPROVED MIX FLOW FAN

FIELD OF THE INVENTION

The present invention relates to a structural reinforcement of the fan wheel a mixed flow fan. More specifically the operational area for the characteristic curve of the mixed flow fan is increased and the possibility of a loss of speed is reduced. Thus the overall performance of the fan is improved.

BACKGROUND OF THE INVENTION

The uses for electrical fans are numerous, including the use in areas like stone working, cement production, chemical engineering, mining, steel working, uses in public transport and disaster control, even in office buildings and simple living rooms fans can be found. The main purpose of an electrical fan is to overcome resistance in pipes while transporting air from one point to another. Fans are widely used in ventilation systems and vacuum cleaners. Upon understanding the characteristics and operations of electrical fans you can achieve great results for the ventilation system with only small efforts. Electrical fans can be separated into four categories, sorted according to their mode of air intake and output: axial fans, mixed flow fans, radial fans, and cross-flow blowers. The industry makes use mainly of three types of fans, the axial fans, the radial fans and the mixed flow fans. The most common used fans here are the mixed flow fans.

It is to be noted that the "optimized blades" described in Taiwan Patent No. 88215121 can be used for general purposes. These blades comprise:

one main fan wheel, comprising several blades, and one air slit construction, attached to the main fan wheel, with the purpose of increasing the air transportation capability of the blades as well as increasing the general air intake.

The above mentioned construction for "optimized blades" has the capability of taking in additional air from the sides of the fan, in addition to the normal air flow. In case of a mixed flow fan the direction of the air flow has to be identical with the rotational axis of the fan wheel. Therefore, the above mentioned construction for "optimized blades", which makes use of a air slit construction attached to the outer rim of the main fan wheel with the purpose of increasing the air intake, can not be used for mixed flow fans as long as this improvement is not adjusted to the special requirements of a mixed flow fan. This improvement is not capable of increasing the airflow through the fan and therefore not capable of increasing the function of a mixed flow fan. The construction used for reference does not meet the demands on the present invention.

SUMMARY OF THE INVENTION

The main purpose of the present invention is to increase the operational area for the characteristic curve of the mixed flow fan.

Another purpose of the present invention is to reduce the possibility of a loss of speed and to improve the overall performance of the fan.

To archive the first purpose, the present invention makes use of the structural reinforcement of the fan wheel of the mixed flow fan. The structure of the fan wheel comprises a hub and several blades attached to the outer rim of this hub.

One side of the hub consists of a hollow space, the other side consists of a flat surface. The blades are attached to the outer rim of the hub in equal distances. The outer rim of the hub is beveled. The flat surface acts as the air inlet side, the hollow side acts as the air outlet side. The surfaces of the blades are to bend. The part connecting the blades to the hub also bends. Therefore cambered channels form in the gaps between the blades, which are arranged in equal distances. Through use of this structure the area of effect for the characteristic curve of the mixed flow fan is increased and the possibility of a loss of speed is reduced. Thus the overall performance of the fan is improved.

BRIEF DESCRIPTION OF THE DRAWINGS

The present invention will be better understood from the following detailed description of preferred embodiments of the invention, taken in conjunction with the accompanying drawings, in which.

DETAILED DESCRIPTION OF THE PREFERRED EMBODIMENT

Figure 1:
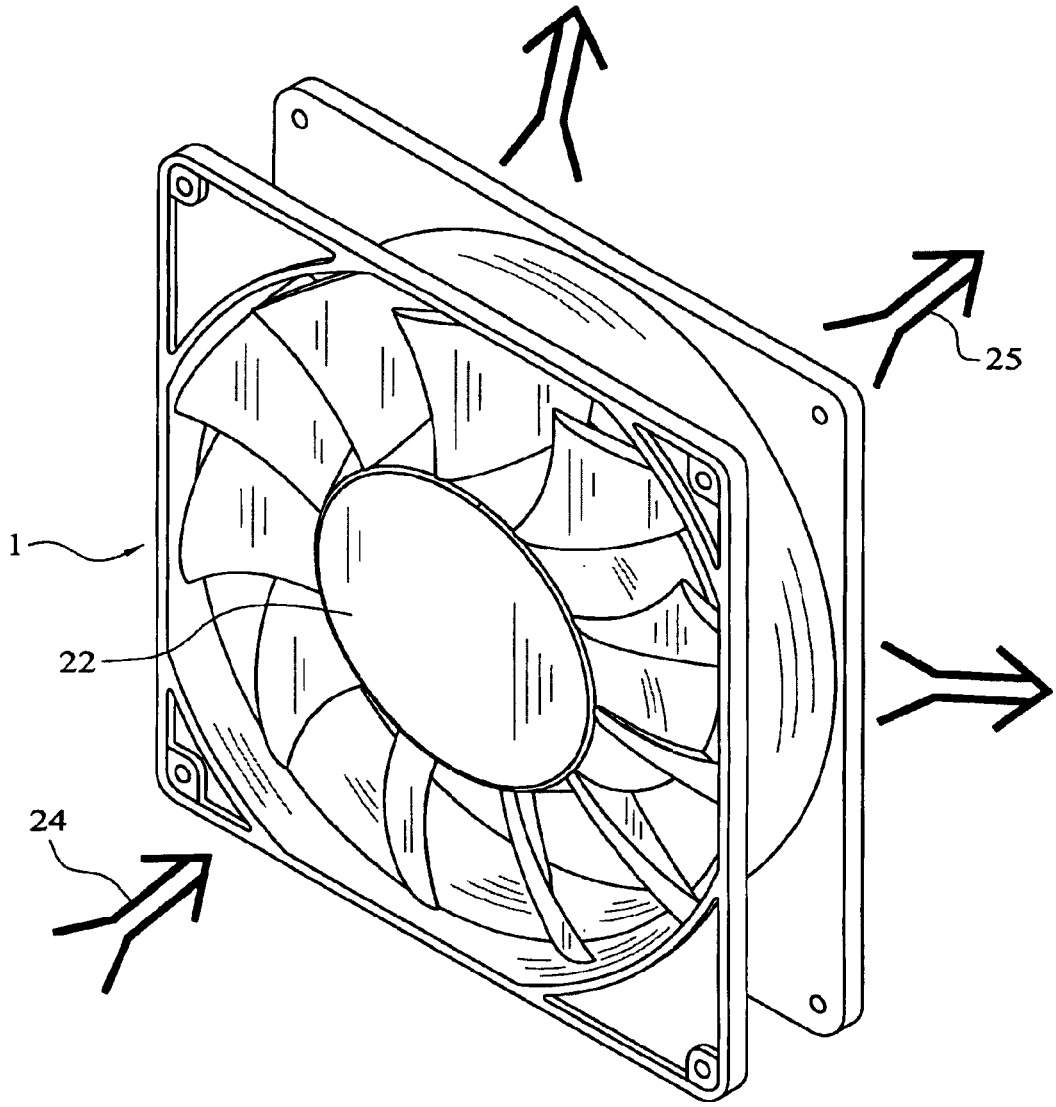
FIG. 1 is a view showing the mix flow fan according to the present invention.
Figure 2:
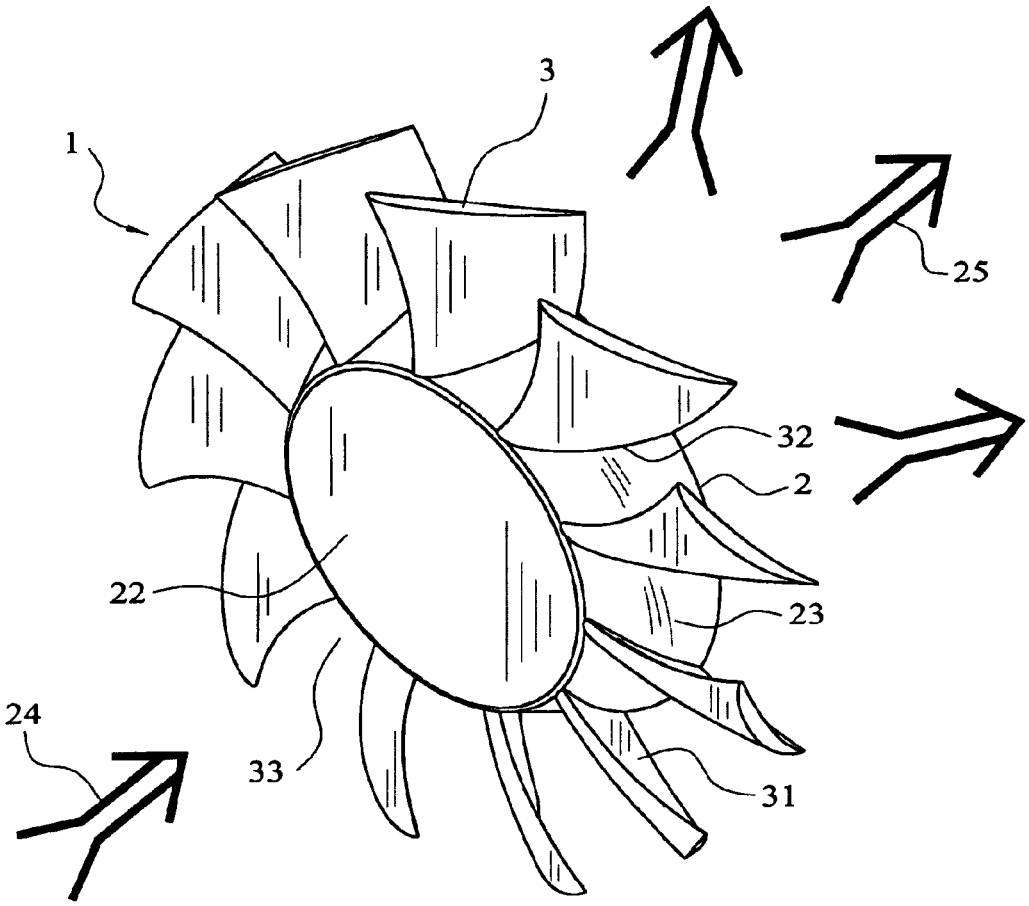
FIG. 2 is a view showing the fan wheel according to the present invention.
Figure 3:
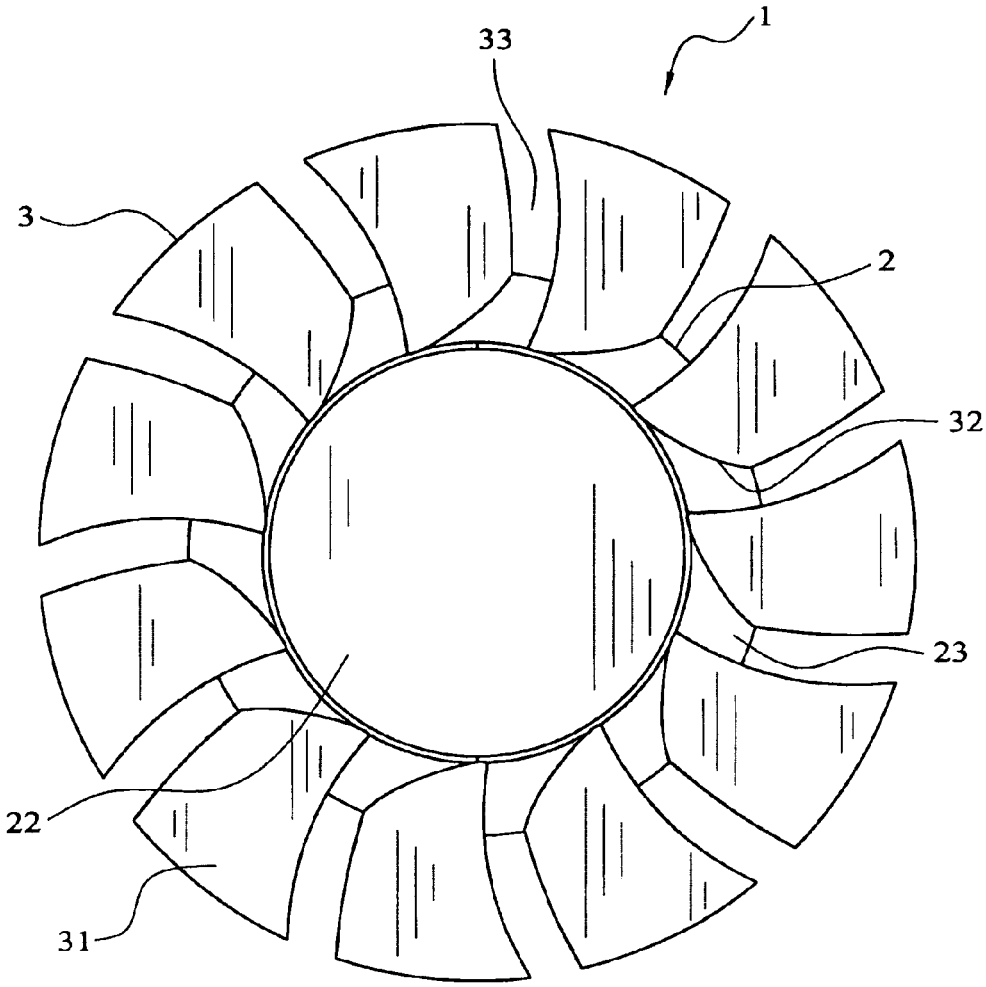
FIG. 3 is a front view of fan wheel according to the present invention.
Figure 4:
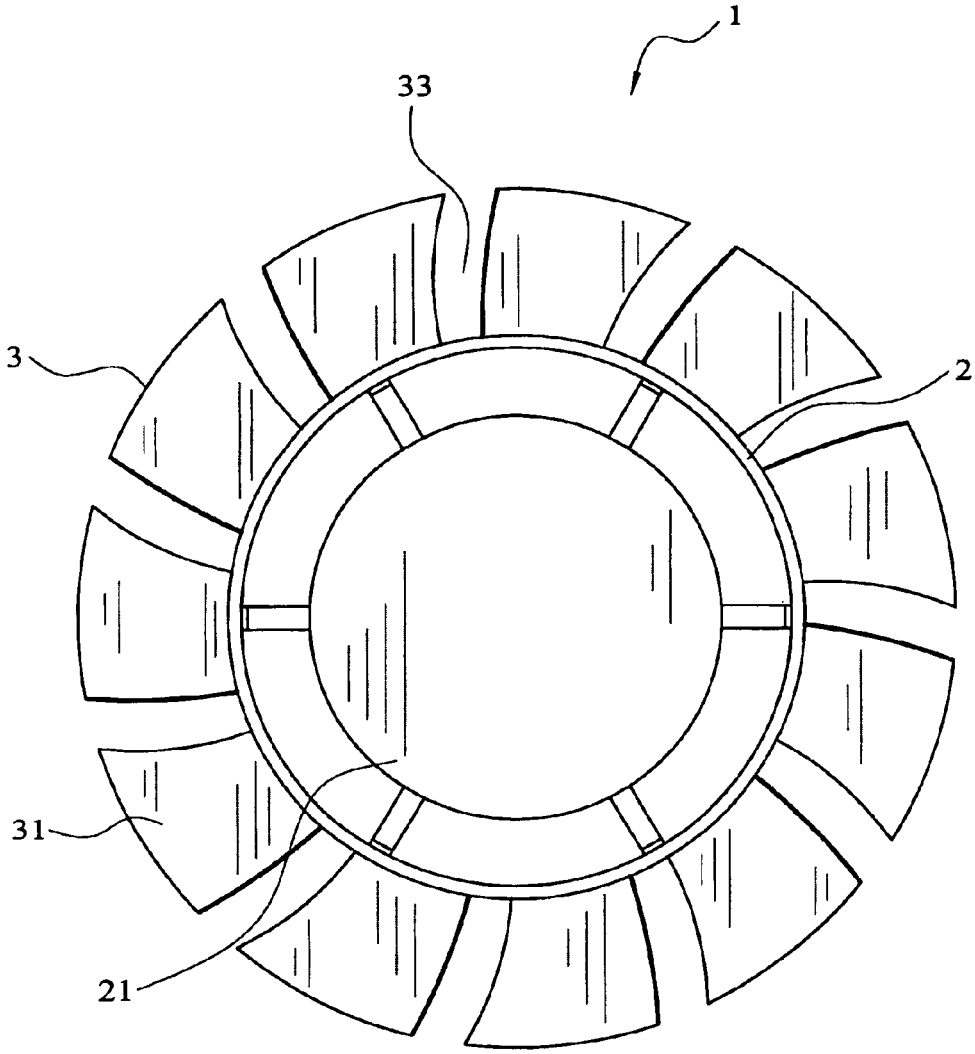
FIG. 4 is a rear view of fan wheel according to the present invention.

The present invention will now be described more specifically with reference to the following embodiments. Please refer to FIG. 1, FIG. 2, FIG. 3 and FIG. 4. These drawings show a mix flow fan of the present invention in use, a fan wheel of the present invention, a front view of fan wheel according to the present invention and a rear view of fan wheel according to the present invention. On the drawings it is shown, that the present invention is a structural reinforcement of the fan wheel of a mixed flow fan, which increases the operational area for the characteristic curve of the mixed flow fan and reduces and the possibility of a loss of speed, thus improving the overall performance of the fan.

The above mentioned fan wheel 1 comprises a hub 2 and several blades 3, which are attached to the outer rim of the hub 2 in equal distances. One side of the hub 2 consists of a hollow space 21, the other side consists of a flat surface 22. The outer rim of the hub 2 is formed by a beveled surface 23. The beveled surface 23 on the outer rim of the hub 2 is formed by a slope descending from the side of the hub 2 on which the hollow space 21 is to the side of the hub 2 which consists of a flat surface 22. The diameter of side of said hollow space 21 is larger than the diameter of side of said flat surface 22. The side of the hub 2, on which the flat surface 22 is, acts as the air inlet side 24, the side of the hub 2, on which the hollow space 21 is, acts as the air outlet side 25. The area ratio of mix flow fan for the air inlet 24 and the air outlet 25 are in a relation of 1.9~2.3.

The blades 3 are attached to the outer rim of the hub 2 in equal distances. The surfaces of the blades 3 are cambered surfaces 31. The part connecting the blades 3 to the hub 2 is also a cambered surface 32. Therefore cambered channels 33 formed in the gaps between the blades 3, which are arranged in equal distances. The cambered surfaces 31 of the blades 3 are attached in the same directions to the beveled outer rim 23 of the hub 3. The construction described above presents a complete new structural reinforcement of the blades of a mixed flow fan.

Figure 5:
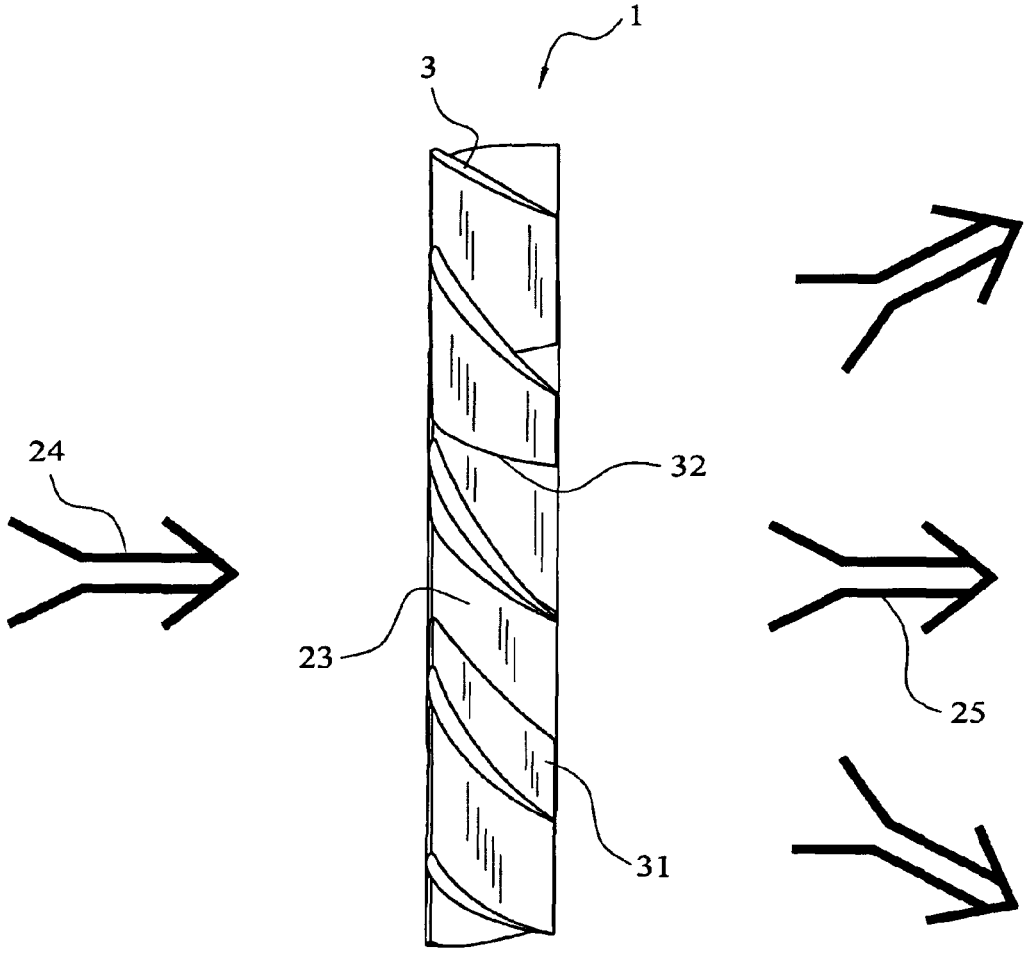
FIG. 5 is a side view showing the air flow through the mix flow fan according to the present invention.
Figure 6:
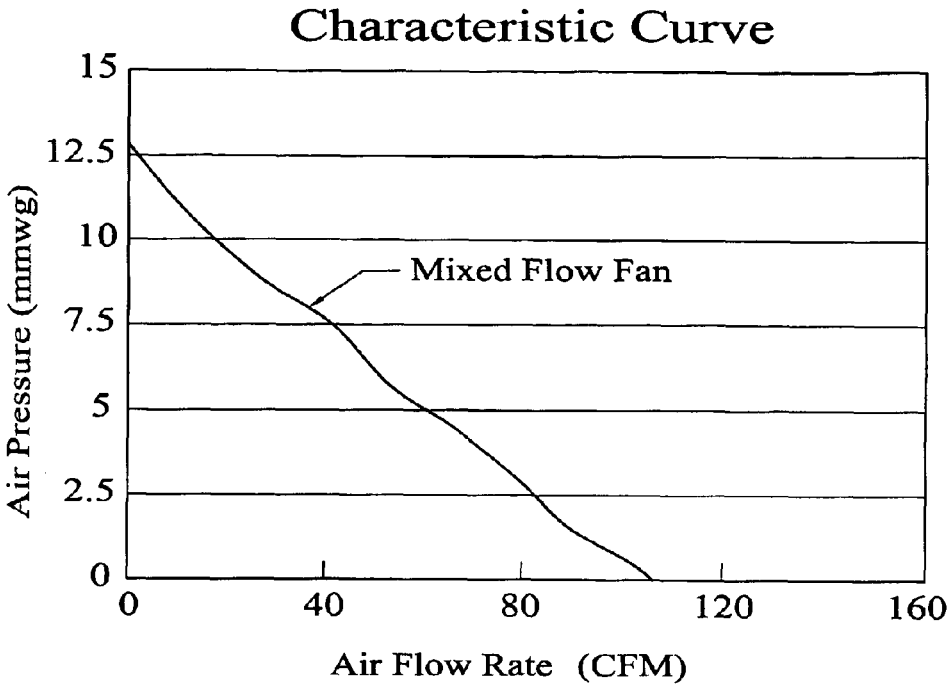
FIG. 6 is a diagram showing the characteristic curve of the mix flow fan according to the present invention.

Please refer to FIG. 5 and FIG. 6. FIG. 5 shows a side view of the air flow through the present invention. FIG. 6 is a diagram showing the characteristic curve of the present invention. The drawings show the following: The fan wheel 1 of the present invention has a hollow space 21. Inside of this hollow space 21 there is a central axis, which also is the central axis for the complete fan (not shown on the drawings). This central axis is used to move the complete fan wheel 1 when connected to a power source. When the fan wheel 1 of the present invention is moved, the air flow is channeled from the direction of the air inlet 24 on the side of the flat surface 22 of the hub 2 to the direction of the air outlet 25 on the side of the hollow space 21 in the hub 2. The blades 3 with their blades being a cambered surface 31, draw in the air through the air inlet 24. The air flow is then channeled through the cambered channels 33, which are formed in the gaps between the blades 3, which are arranged in equal distances. While doing so, the air flow is adjusted to the form of the beveled surface 23 on the outer rim of the hub 2 and the cambered surfaces 31 of the blades 3. The air flow finally emerges through the air outlet 25. Thus the operational area for the characteristic curve of the mixed flow fan is increased and the possibility of a loss of speed is reduced (as shown on FIG. 5). The overall performance of the fan is improved. The characteristics and features of the present invention are proven by data collected through a fan-testing-machine constructed by Engineering Laboratory Design, Inc., using the ASHRAE-standards 51-1985.

In summation of the foregoing section, the invention herein fully complies will all new patent application requirement and is hereby submitted to the patent bureau for review and granting of the commensurate patent rights.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed is:

1. A mix flow fan comprising:

a) a central hub having:

i) an outer rim being a beveled surface;

ii) a flat surface located on a first end of the outer rim; and iii) a hollow space located on a second end of the outer rim, the outer rim slopes outwardly from the flat surface to the hollow surface, the flat surface having a diameter that is smaller than a diameter of the hollow surface;

b) a plurality of blades equally spaced around an exterior of the bevel surface, each of the plurality of blades having bent surfaces and a bent end connected to the outer rim and extending from the first end of the outer rim to the second end of the outer rim; and c) a plurality of cambered channels formed between adjacent blades of the plurality of blades, wherein an area ratio of air inlet to air outlet is between 1.9 and 2.3.

* * * * *